United States Patent [19]

Gumb et al.

[11] 4,061,411

[45] Dec. 6, 1977

[54] MULTI-OUTLET ADAPTOR FOR PLUG-IN TELEPHONES

[75] Inventors: Beverley William Gumb; Gerd Kuhfus; Fredrick Thomas Cogan, all of London, Canada

[73] Assignee: Northern Telecom Limited, Montreal, Canada

[21] Appl. No.: 761,066

[22] Filed: Jan. 21, 1977

[51] Int. Cl.[2] ..... H01R 27/02

[52] U.S. Cl. ..... 339/159 R; 179/1 PC

[58] Field of Search ..... 339/91 R, 99 R, 176 M, 339/154–159, 166 R, 170; 179/1 PC

[56] References Cited

U.S. PATENT DOCUMENTS

| | | | |
|---|---|---|---|
| 2,654,074 | 9/1953 | Lancelot | 339/159 L |
| 3,668,324 | 6/1972 | Firestone | 339/156 R |
| 3,761,869 | 9/1973 | Hardesty et al. | 339/99 R |

*Primary Examiner*—Roy Lake
*Assistant Examiner*—Neil Abrams
*Attorney, Agent, or Firm*—Sidney T. Jelly

[57] ABSTRACT

A multi-outlet adaptor for plug-in telephones is in the form of a hollow box-like member in the front of which are at least two apertures with a jack aligned with and behind each aperture. A plug can be inserted through each aperture. On the rear of the box-like member is an integral plug for insertion in the normal telephone outlet or jack. The jacks in the adaptor are wired in parallel to the plug on the rear. A latch can be provided on the plug and the apertures can be profiled to provide latch engaging formations.

4 Claims, 10 Drawing Figures

MULTI-OUTLET ADAPTOR FOR PLUG-IN TELEPHONES

This invention relates to a multi-outlet adaptor for plug-in telephones.

It has been proposed to provide a plug-in facility for domestic and similar telephones, to permit the user to change the cord of a telephone if damaged and to permit movement of a telephone from one outlet jack to another. Each outlet accepts one plug.

The present invention provides an adaptor whereby extra jacks or outlets are provided so that a person having a conventional phone can also plug in additional items, for example a "handsfree" unit which permits answering, and using, a phone without removing the handset from the telephone unit, and/or a telephone answering device. At present such extra devices need to be installed by a service representative or special equipment is necessary. The present invention avoids a considerable amount of field work by installation personnel.

The invention will be readily understood by the following description in conjunction with the accompanying drawings, in which.

Figure 1:
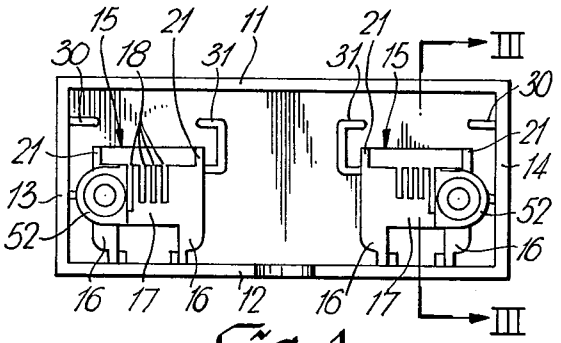
FIG. 1 is a rear view of the front main part of an adaptor.
Figure 2:
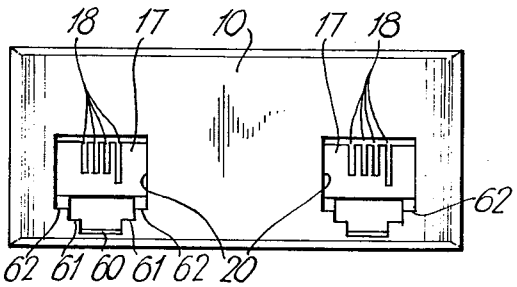
FIG. 2 is a front view of the main part of an adaptor.
Figure 3:
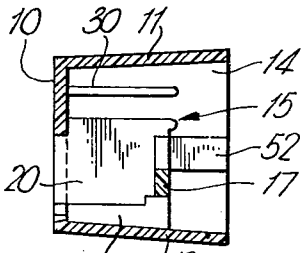
FIG. 3 is a cross-section on the line III—III of FIG. 1.

As illustrated in FIGS. 1, 2 and 3, the main part of a connector is of hollow box-like form having a front 10, top and bottom 11 and 12, and ends 13 and 14. The part 10 is of molded construction of electrically insulating material and formed integrally with the front 11, on the inside thereof, over the lower parts 15 of two jacks or outlets. Each part 15 consists of two spaced apart walls 16 which extend from the front 11. At the rear the walls 16 are connected by a bridge 17. Slots 18 extend down from a top surface of the bridge.

Formed in the front 11 are apertures 20, shaped to fit a plug, not shown. The walls 16 are coincident with the sides of the apertures and the bottom 12 is coincident with the bottoms of the apertures, and define plug-receiving cavities.

Figure 4:
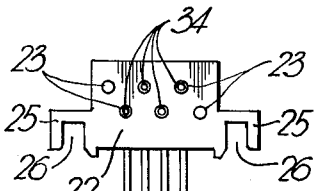
FIGS. 4, 5 and 6 are back, front and side views respectively, of one of two connector parts inserted in the main part of the connector.
Figure 5:
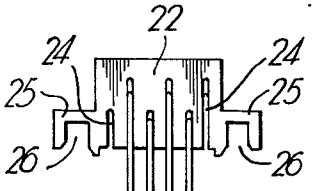
Figure 6:
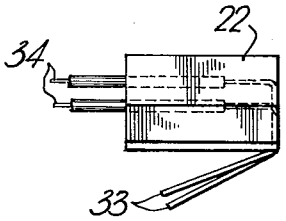
Figure 10:
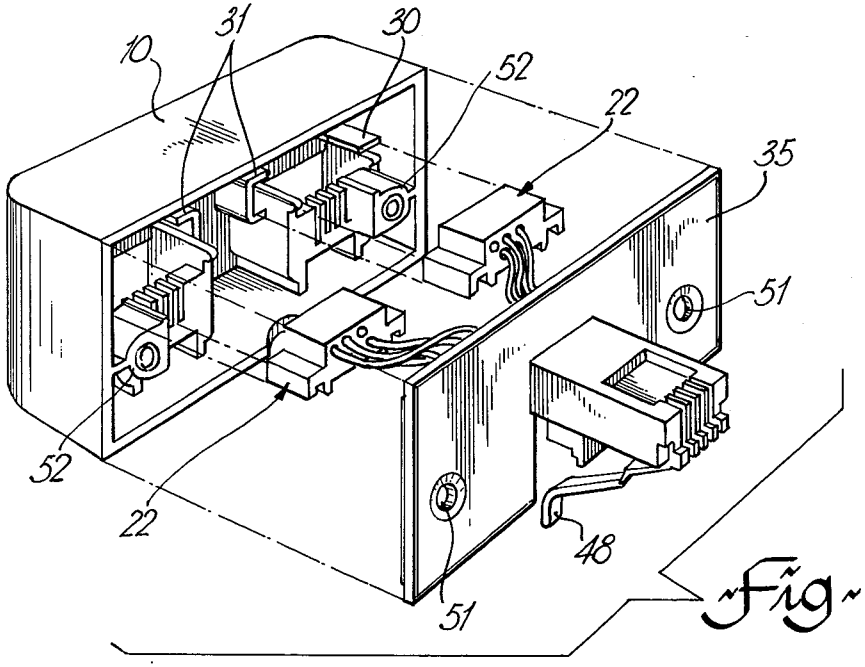
FIG. 10 is a perspective exploded view of a complete adaptor.

The top edges of the walls 16 extend above the bridge 17, as indicated at 21. Slideable on the top edges 21 of the walls 16 are the top parts of the jacks or outlets, illustrated in FIGS. 4, 5 and 6. Each top part is molded of electrically insulating material. Each jack has a main portion 22 having a plurality of bores 23 extending therethrough from front to rear. Grooves 24 extend down the front of the main portion, from each bore 23. At each side of the main portion 22 is a lateral extension 25 having a channel 26 in its undersurface. The channels 26 are spaced apart, and of a width that they will slide on top of the top edges 21 of the walls 16 of the lower parts 15.

To retain the top parts of the jacks on the top edges of the walls 16, retaining members 30 are provided on the ends 13 and 14 and further retaining members 31 extend from the front 11 alongside the inner walls 16, that is the two adjacent or inner walls of the two jacks. The retaining members 30 and 31 hold the top parts of the jacks down on the lower parts.

Extending from the front ends of the bores 23 are spring contacts 32. The contacts 32 are bent down to rest in the grooves 24 and then bent rearwards, as indicated at 33 in FIG. 6. When the upper parts are slid onto the lower parts, the parts 33 fit into the slots 18 in the bridge 17. In the bores 23 the contacts 32 are connected to conductors 34. The number of contacts 32, and position, can be varied. When fully inserted the upper parts of the jacks define the tops of the plug-receiving cavities and the contacts 32 are positioned for contacting by terminals in plugs inserted into the cavities.

Figure 7:
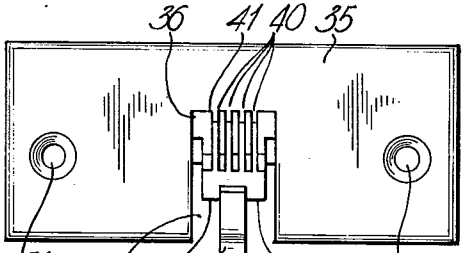
FIG. 7 is a rear view of the back cover of the connector.
Figure 9:
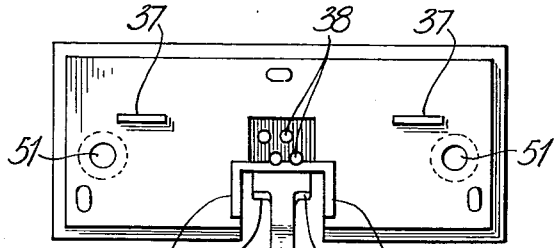
FIG. 9 is a rear view of the back cover.
Figure 8:
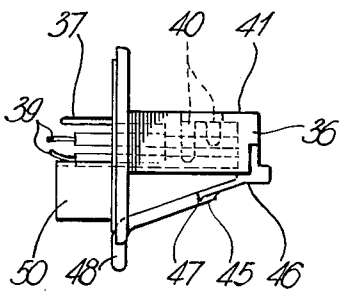
FIG. 8 is a side view of the back cover.

The back cover illustrated in FIGS. 7, 8 and 9 is also molded of electrically insulating material, comprising a main flat portion 35 for matching with the top, bottom and ends of the main portion of the adaptor and has, integrally molded as part of the cover, a plug member 36. Plug member 36 extends from the near or outer surface of the cover, when the cover is attached. On the inside of the cover two locating members 37 are formed. These locating members 37 abut against the top parts of the jacks in the main part of the adaptor, to retain the top parts in position. In the present example the members 37 contact the main portions 22 of the top parts below the bores 23 to avoid interfering with the conductors 34.

The plug member 36 has bores 38 extending therethrough into which conductors 39 are fitted. Metal terminals 40 are pressed down from the top surface 41 of the plug member, the terminals having insulation piercing points which pierce through the insulation of the conductors 39 to make contact with the metal conductor core. Grooves 42 extend from top and bottom of the front face of the plug member 36, a groove communicating with each bore 38, and these grooves extend along the top surface 41 for a short distance. The grooves 42 act to align spring contacts in a wall jack or outlet, such a jack being similar to one of the jacks in the adaptor. The conductors 39 are connected to the conductors 34 of the jacks in the adaptor.

To prevent inadvertent withdrawal of the adaptor from a wall, or similar jack, a latch member 45 is provided. The latch member 45 is hingedly attached to the outer end of the plug member 36 by a portion 46 of the reduced thickness, the latch flexing at this portion. At the reduced portion, the width of the latch member is wider than for the remainder, forming two lateral extensions 47, one on each side. On insertion of the plug member into a jack, the extensions 47 snap down behind projections in the jack. The plug member can be withdrawn by flexing the latch member, by pressing on the end 48. The end 48 is bent down, as seen in FIG. 8, and is positioned in a wide slot 49 in the cover. To shield the exterior of the adaptor, the slot 49 is surrounded on three sides by a web 50.

The cover is attached to the main part of the adaptor by screws passing through holes 51 in the cover into bosses 52 formed on one of the walls 16 of each of the jack parts 15.

Retaining means are also provided in the jacks in the adaptor to prevent inadvertent withdrawal of plugs. As seen in FIG. 2, the apertures 20 have a predetermined profile. The bottom edge of each profile is stepped, having a central portion 60, a first step 61 on each side and then a second step 62 on each side. A plug, when inserted, slides along on the second step 62, while the wider part of a latch member slides over the first step 61. The first steps 61 extend only for approximately the thickness of the front 11 of the main portion of the adaptor and when fully inserted the wide part of the latch drops down behind the steps 61. The main part of a latch member rests in the central portion 60, which is inclined to conform with the angle of the latch member. As with the latch member 45, for the plug member 36, deflection of a latch member of a plug releases it from behind the steps 61 and permits withdrawal of the plug.

What is claimed is:

1. A multi-outlet adaptor for plug-in telephones, comprising:

a main part of hollow box-like form having a front, top and bottom, and ends;

at least two apertures in said front, said apertures each having a predetermined profile for reception of a plug therein;

a jack aligned with each aperture, said jacks on the inside of said front and each comprising a lower part integral with said front and an upper part positioned on said lower part, each lower part comprising two spaced apart side walls extending normal to said front and a bridge member at the rear of said side walls and extending between said side walls and integral therewith, and each upper part including two spaced apart parallel channels in an undersurface thereof, said channels slidable on said side walls of said lower part;

a retaining member on each end of the inside thereof and two further retaining members extending from the inside of said front, said retaining members extending over said side walls of said lower parts to retain said top parts of said jacks on said lower parts;

a back cover attached to said main part at the back thereof and a plug extending from said cover, in a direction away from said main part, said plug integral with said back cover; and conductors in said plug and said jacks, the conductors in said jacks connected in parallel to said conductors in said plug.

2. An adaptor as claimed in claim 1, each said top part of a jack including a plurality of bores extending therethrough in a direction normal to said front, and spring contacts in said bores, said spring contacts extending forward through said bores and bent down to extend down the front of said upper part, said contacts then bent rearwards beneath said upper parts, and slots in said bridge member of each lower part, said slots extending downwards from a top edge of said bridge member, said contacts positioned one in each slot with said top part on said lower part.

3. An adaptor as claimed in claim 1, said profile of each of said apertures including a bottom edge, said bottom edge stepped and including a centre portion and at least one step on each side of said centre portion, said steps forming latch retaining means on a latch of a plug inserted in an aperture into the related jack.

4. An adaptor as claimed in claim 1, including latch means on said plug for releasably retaining said plug in a telephone outlet.

* * * * *